US006658780B2

(12) United States Patent
Papadimas

(10) Patent No.: US 6,658,780 B2
(45) Date of Patent: Dec. 9, 2003

(54) REVOLVER DEVICE

(76) Inventor: Aris Papadimas, Oslogatan 34, 164 31 Kista (SE)

( * ) Notice: Subject to any disclaimer, the term of this patent is extended or adjusted under 35 U.S.C. 154(b) by 0 days.

(21) Appl. No.: 10/214,916

(22) Filed: Aug. 7, 2002

(65) Prior Publication Data

US 2003/0046851 A1 Mar. 13, 2003

Related U.S. Application Data

(60) Provisional application No. 60/317,683, filed on Sep. 6, 2001.

(51) Int. Cl.[7] ..... F41C 3/14; F41A 3/76
(52) U.S. Cl. ..... 42/59; 42/65
(58) Field of Search ..... 42/59, 65; 89/155, 89/156, 157, 158, 159

(56) References Cited

U.S. PATENT DOCUMENTS 132,357 A * 10/1872 Davis ..... 42/59
325,878 A * 9/1885 Tyler ..... 42/59
3,056,225 A * 10/1962 Yeomans, Jr. ..... 42/39.5
4,455,777 A * 6/1984 Callies ..... 42/59
4,918,850 A * 4/1990 Rick ..... 42/59
5,048,216 A * 9/1991 Casull ..... 42/76.01
5,333,531 A * 8/1994 Field ..... 89/26

FOREIGN PATENT DOCUMENTS

FR 2761764 A * 10/1998 ..... F41A/3/76

* cited by examiner

*Primary Examiner*—Charles T. Jordan
*Assistant Examiner*—John W. Zerr
(74) *Attorney, Agent, or Firm*—Rolf Fasth; Fasth Law Offices

(57) ABSTRACT

The shooting device, such as a revolver, has a housing with a barrel-receiving opening defined therein. A cylinder and a barrel are attached to the housing. The barrel has a rear section with a cylindrical segment that slidably engages the cylindrical segment. A spring has one end attached to the rear section of the barrel and a second opposite end attached to the cylindrical valve for urging the valve against a groove section of the cylinder so there is a tight fit between the valve and the cylinder during the firing of the bullet. This prevents any pressure loss when the bullet is fired.

10 Claims, 4 Drawing Sheets

REVOLVER DEVICE

PRIOR APPLICATION

This application claims priority from U.S. Provisional Patent Application No. 60/317,683; filed Sep. 6, 2001.

TECHNICAL FIELD

The present invention relates to a highly efficient revolver device.

BACKGROUND AND SUMMARY OF THE INVENTION

The current design of revolvers has not changed much in the last century. Conventional revolvers have a slight gap defined between the rotatable cylinder and the back end of the revolver barrel that results in pressure losses so that the speed of the bullet is reduced. During the blast, conventional revolvers are quite noisy due to the leakage between the cylinder and the barrel so that particles may blasts out through the gap. It is often necessary to use more powder to compensate for the pressure losses. There is a need for a more efficient design that improves the performance of the revolver.

The shooting device of the present invention solves the above-outlined problems. More particularly, the shooting device, such as a revolver, has a housing with a barrel-receiving opening defined therein. A cylinder and a barrel are attached to the housing. The barrel has a rear section with a cylindrical segment that slidably engages the cylindrical segment. A spring has one end attached to the rear section of the barrel and a second opposite end attached to the cylindrical valve for urging the valve against a groove section of the cylinder so there is a tight fit between the valve and the cylinder during the firing of the bullet. This prevents any pressure loss when the bullet is fired.

DETAILED DESCRIPTION

Figure 1:
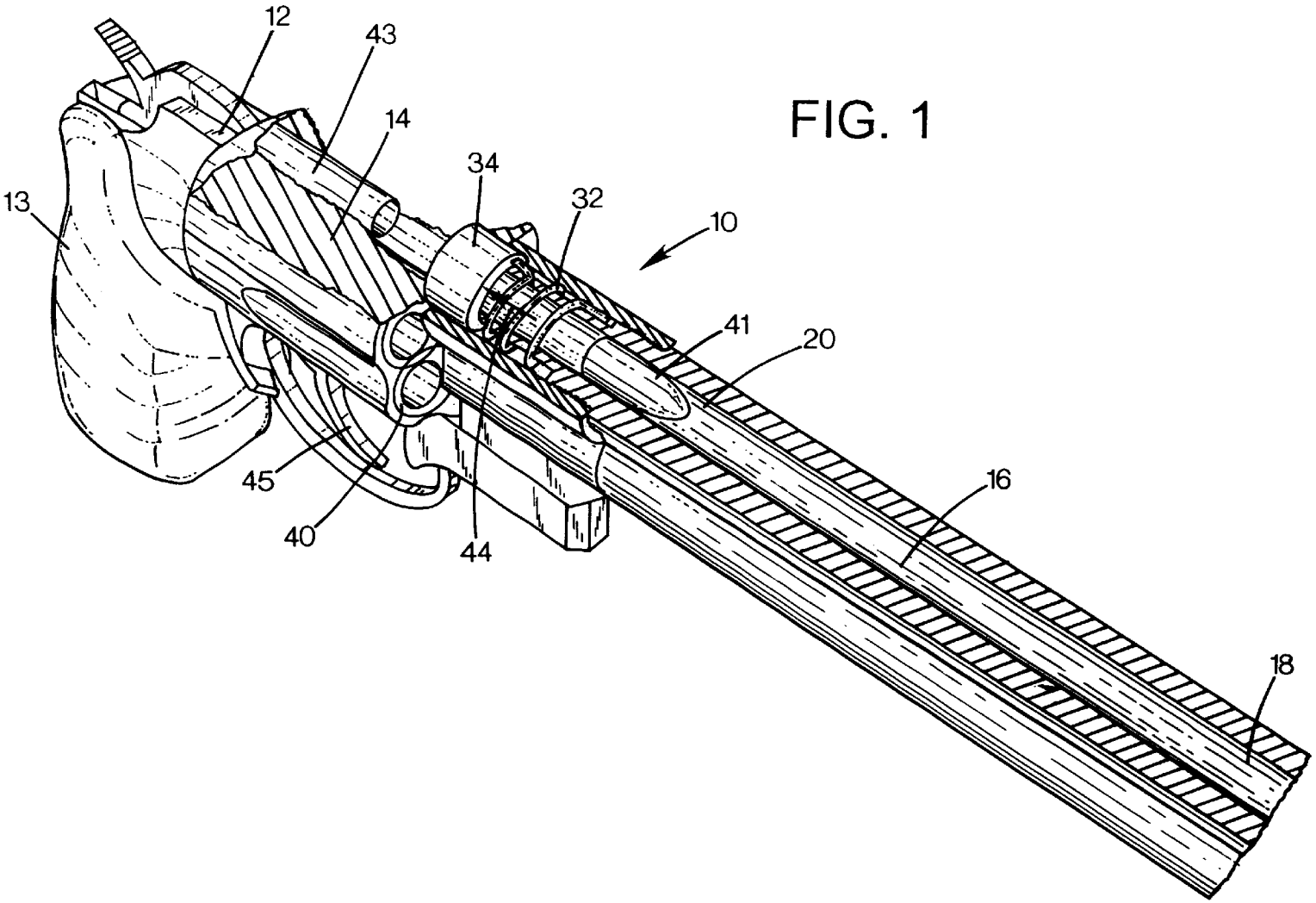
FIG. 1 is a perspective view of the revolver device of the present invention.
Figure 2:
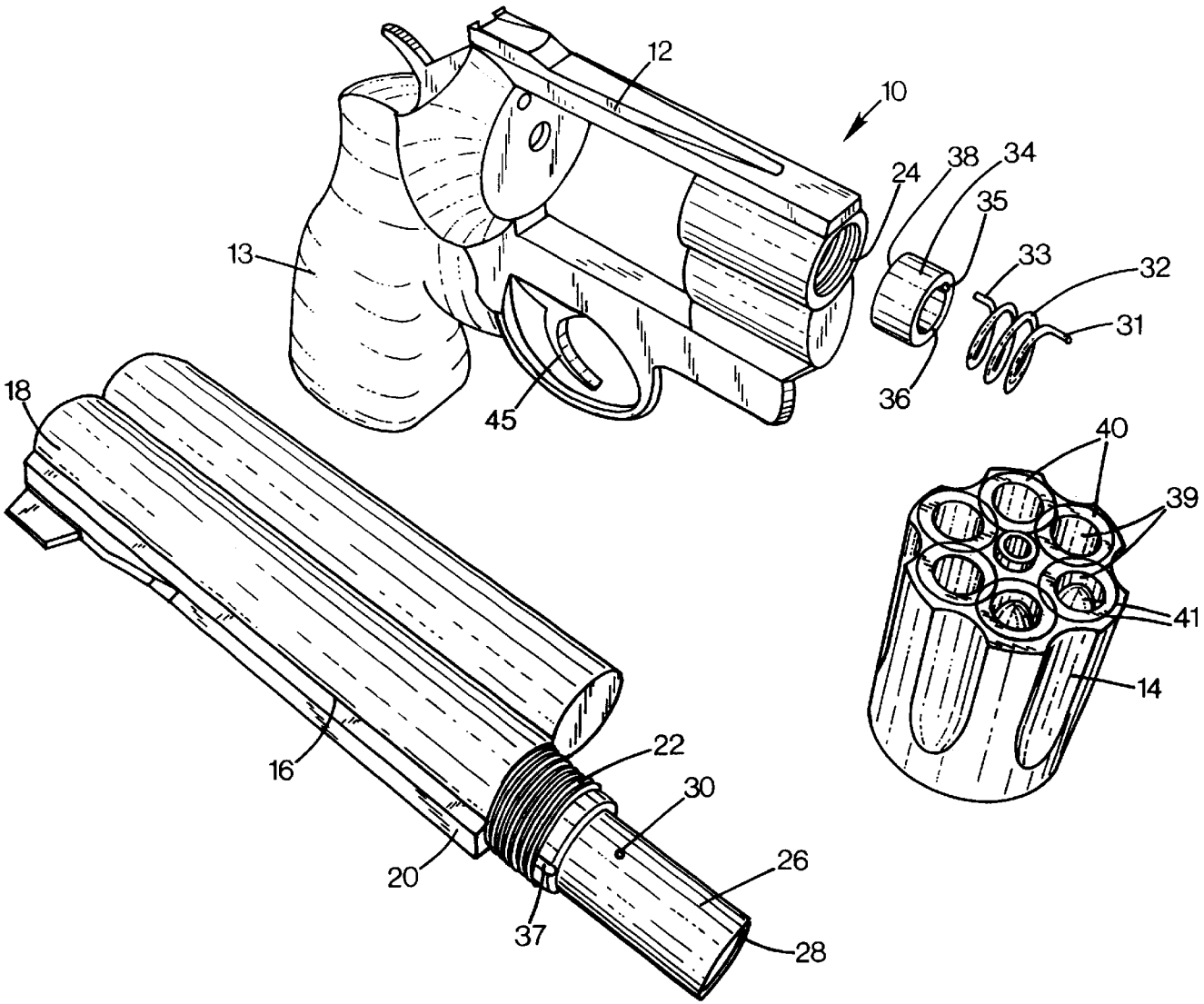
FIG. 2 is an exploded view of the revolver device of the present invention.

With reference to FIGS. 1–4, the high efficiency shooting device 10 of the present invention has a housing 12 with a handle 13. The shooting device of the present invention may be any type of shooting device, such as a revolver, that has a rotatable cylinder for holding the bullets. A cylinder 14 is rotatably attached to the housing 12. A barrel 16 is attached to the housing 12. A special feature of the revolver device 10 is that there is a tight fit between the cylinder containing bullets and the barrel. A barrel 15, attached to the housing 12, has a front section 18 and a rear section 20. The roar section 20 has a threaded portion 22 that may be screwed into a threaded portion of an opening 24 of the housing 12. The section 20 also has a smooth cylindrical segment 26 with a round end surface 28. The segment 25 has openings 30, one of each side of the segment 26, defined therein that is in fluid communication with the hollow inside of the segment 26. An important feature is that a first end 31 of a helical spring 32 may be attached to a groove 37 in the threaded portion 22 or the segment 26. A cylindrical valve 34 has an opening 36 extending there through and a second end 33 of the helical spring 32 may be attached to the valve 34 because the valve has a groove 35 that may snugly receive the end 33.

Preferably, the valve 34 has an inner diameter that snugly fits an outer diameter of the segment 26 so that the valve 34 may slide along the segment 26. The outside diameter of the valve 34 is such that the valve 34 may snugly slide inside the opening 24. The dimensions of the valve are precisely engineered so that the valve 34 may slide in the opening 24 and on the segment 26 without allowing any or very little pressure to escape therebetween. One function of the spring 32 is to urge an inside surface 38 of the valve 34 against grooved or recessed sections 40 of the cylinder at bullet openings 39 defined in the cylinder 14. The sections 40 are dimensioned to hold bullets 41, including cartridges 43, therein that are exploded when a trigger 45 is pulled so that a bullet is propelled through the barrel 16. A detailed view of the sections 40 in shown in FIG. 4. The sections 40 are dimensioned to receive the surface 38 to provide a tight fit between the section 40 and the surface 38 when the section 40 is lined up in front of the surface 38 so that the spring 32 may urge the surface 38 into the groove section 40. However, the force is such that it is possible to rotate the cylinder 16 although the valve 34 bears against the recessed section 40. In other words, it is possible to compress the section 32 slightly so that the valve 34 may snapped out of the section 40 and into the next section 40 as the cylinder 16 is rotated.

Figure 3:
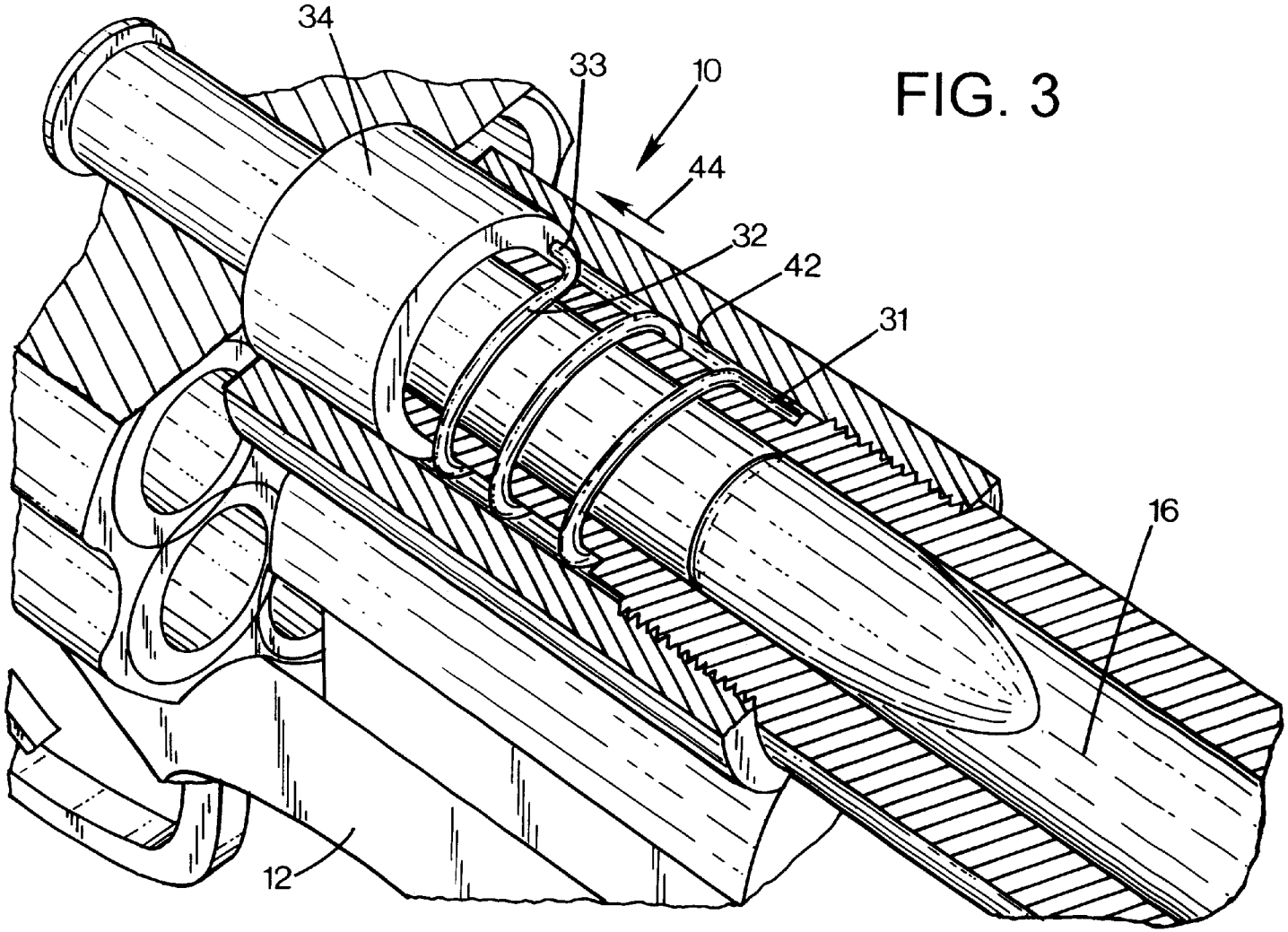
FIG. 3 is a detailed perspective view of rear portion of the revolver pipe of the present invention.
Figure 4:
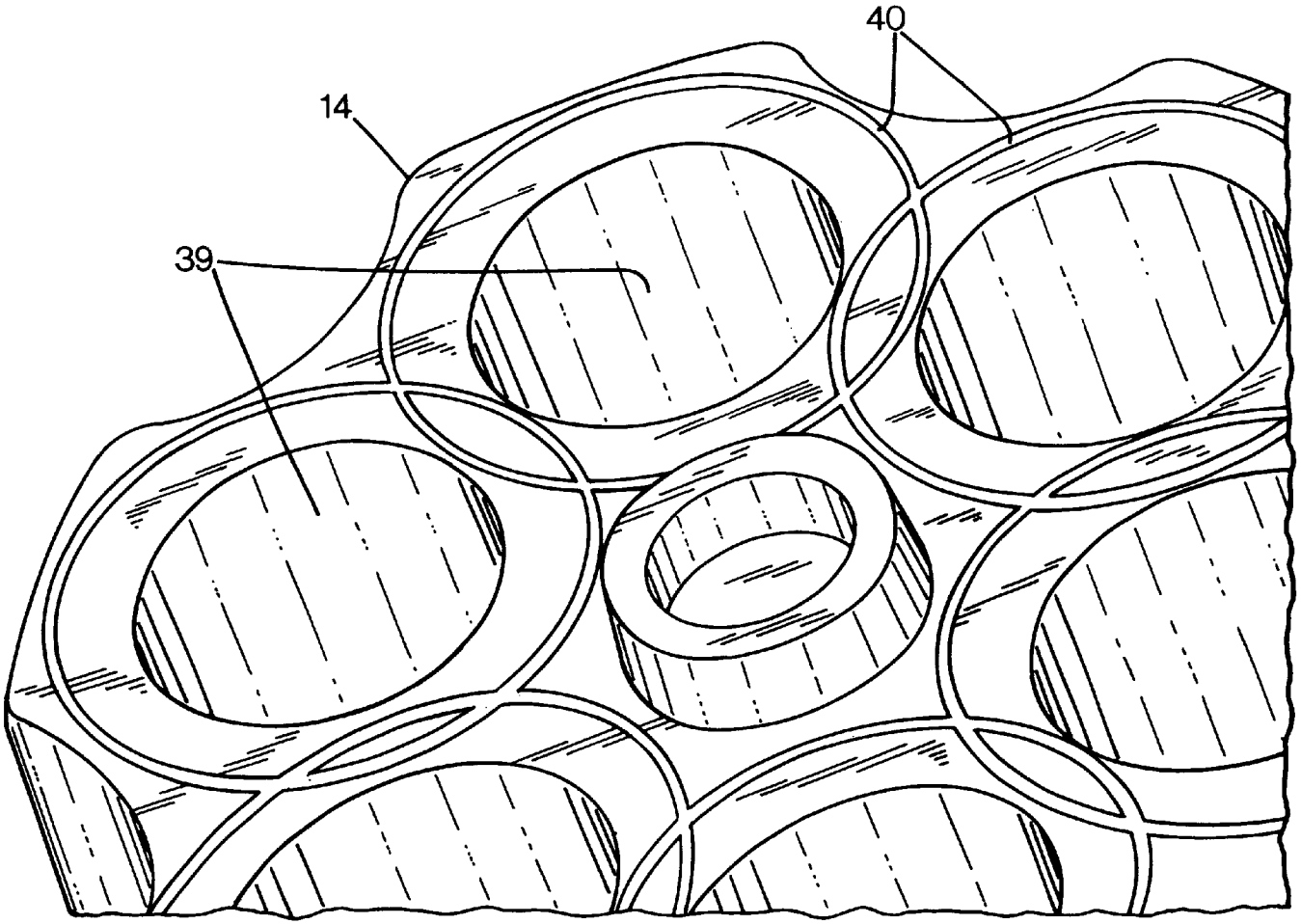
FIG. 4 is a detailed view of the cylinder of the present invention.

With reference to FIG. 3, a chamber 42 is defined between the inside of the barrel 16 and the reduced diameter segment 26. The spring 32 is disposed in this chamber 42 and the chamber 42 may be pressurized through incoming air through the opening 30 due to the exploding powder. The sudden pressure increase in the chamber 42 further urges the valve 34 to slide on the segment 25 against the section 40 to minimize any pressure losses during the fire of the revolver device 10 that a bullet 41 may be ejected from the cylinder 14 through the valve 34 into the segment 26 of the barrel 16 without any pressure looses. An arrow 44 shows the explosion force on the valve 34 to move backwardly towards the section 40 of the cylinder 14. This force is substantially greater than the spring force generated by the spring 32. There is also a pressure behind the bullet as the fired bullet passes the opening 30 so that the valve 34 is continuously being pressed against the recess 40 when the bullet travels inside the barrel 16. The pressure on the valve 34 is eased when the bullet leaves the barrel 16 and the valve is again exposed to atmospheric pressure. Because the valve 34 is tightly pressed against the recessed section 40 of the cylinder 16 during the firing of the bullet, there is virtually no loss of pressure and no particles eject between the barrel and the cylinder. There is also less noise and the speed of the bullet may be maintained without speed loss due to the pressure loss.

While the present invention has been described in accordance with preferred compositions and embodiments, it is to be understood that certain substitutions and alterations may be made thereto without departing from the spirit and scope of the following claims.

I claim:

1. A shooting device, comprising:

a housing having a barrel receiving opening defined therein;

a cylinder having a bullet opening defined therein for holding a bullet, the cylinder being rotatably attached to the housing;

a barrel attached to the housing, the barrel having a rear section with a cylindrical segment;

a cylindrical valve slidably engaging the cylindrical segment of the barrel, the valve having an outer diameter dimensioned to snugly fit inside the barrel receiving opening; and spring means for biasing the valve against the cylinder, the spring means having one end attached to the rear section of the barrel and a second opposite end attached to the valve.

2. The shooting device according to claim 1 wherein the spring means is a helical spring that has a first end attached to a groove defined in the rear section of the barrel and a second end is attached to a groove defined in the valve.

3. The shooting device according to claim 1 wherein the valve has an inner diameter dimensioned to snugly slide along the cylindrical segment.

4. The shooting device according to claim 1 wherein the bullet opening has a groove section defined therein for receiving an inside surface of the valve.

5. The shooting device according to claim 4 wherein the cylinder is rotatable when the valve engages the groove section of the bullet opening by compressing the helical spring.

6. The shooting device according to claim 2 wherein the barrel has a chamber defined therein at the cylindrical segment and the helical spring is disposed in the chamber.

7. A method of ejecting a bullet from a shooting device, comprising:

providing a housing having a barrel receiving opening defined therein, a cylinder rotatably attached to the housing and a barrel attached to the housing, the cylinder having a bullet holding opening defined therein, the barrel having a rear section with a cylindrical segment, a cylindrical valve slidably engaging the cylindrical segment of the barrel, and a spring having one end attached to the rear section and a second opposite end attached to the valve;

activating a trigger to fire a bullet placed in the cylinder;

the fired bullet urging air in through an opening defined in the cylindrical segment and into a chamber defined between an inside of the barrel and an outside of the cylindrical segment to pressurize the chamber; and the valve, disposed in the pressurized chamber, being urged to slide on the cylindrical segment to engage a grooved section at the bullet holding opening of the cylinder to provide a tight fit between the valve and the cylinder.

8. The method according to claim 7 wherein the method further comprises urging the valve in a direction that is parallel to the barrel.

9. The method according to claim 7 wherein the method further comprises propelling the bullet through the valve.

10. The method according to claim 9 wherein the method further comprises propelling the bullet through the spring.

* * * * *